United States Patent [19]

Hovind

[11] Patent Number: 4,466,225

[45] Date of Patent: Aug. 21, 1984

[54] STUD EXTENDERS

[75] Inventor: John K. Hovind, Clarence, N.Y.

[73] Assignee: National Gypsum Company, Dallas, Tex.

[21] Appl. No.: 327,215

[22] Filed: Dec. 3, 1981

[51] Int. Cl.[3] ..... E04C 3/30

[52] U.S. Cl. ..... 52/730; 52/733; 52/481; 52/347

[58] Field of Search ..... 52/481, 347, 346, 376, 52/727, 728, 720, 730, 731, 732, 733, 740, 712, 696, 480

[56] References Cited

U.S. PATENT DOCUMENTS

| | | | |
|---|---|---|---|
| 397,868 | 2/1889 | Mesker | 52/727 |
| 574,641 | 1/1897 | Streator | 52/728 |
| 1,194,690 | 8/1916 | Adams | 52/727 |
| 1,453,996 | 5/1923 | Riddle | 52/376 |
| 1,703,566 | 2/1929 | Baum | 52/376 |
| 1,946,560 | 2/1934 | Wick | 52/376 |
| 2,039,382 | 5/1936 | Balduf | 52/346 |
| 2,041,773 | 5/1936 | Manske | 52/346 |
| 2,154,944 | 4/1939 | Kullmer | 52/376 |
| 2,723,730 | 11/1955 | Bailey | 52/696 |
| 3,046,620 | 7/1962 | Tvorik | 52/346 |
| 3,413,771 | 12/1968 | Dudley | 52/480 |
| 3,945,167 | 3/1976 | Wendt | 52/731 |
| 4,275,541 | 1/1981 | Orals | 52/481 |
| 4,333,290 | 6/1982 | Koberstein | 52/376 |
| 4,366,659 | 1/1983 | Jensen | 52/696 |

FOREIGN PATENT DOCUMENTS

| | | | |
|---|---|---|---|
| 1026515 | 3/1958 | Fed. Rep. of Germany | 52/727 |
| 581754 | 10/1946 | United Kingdom | 52/727 |

*Primary Examiner*—Henry E. Raduazo

*Attorney, Agent, or Firm*—Robert F. Hause

[57] ABSTRACT

Sheet metal formed into J-shaped or C-shaped cross section clips or channel that may contain short tabs struck out of the wide side or sides for positioning the clips or channel on a wood 2×4 to convert it effectively into deeper framing members such as a 2×6, providing room for the additional insulation required for present day energy conservation.

8 Claims, 3 Drawing Figures

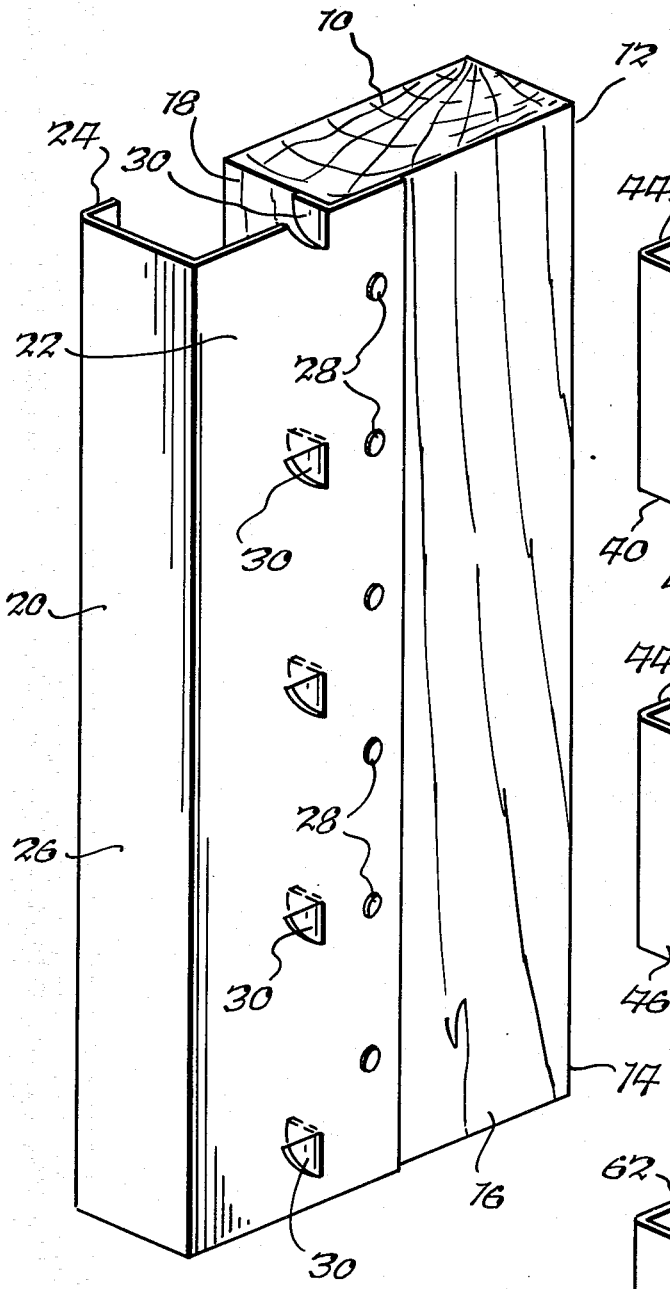
Fig. 1.
Fig. 2.
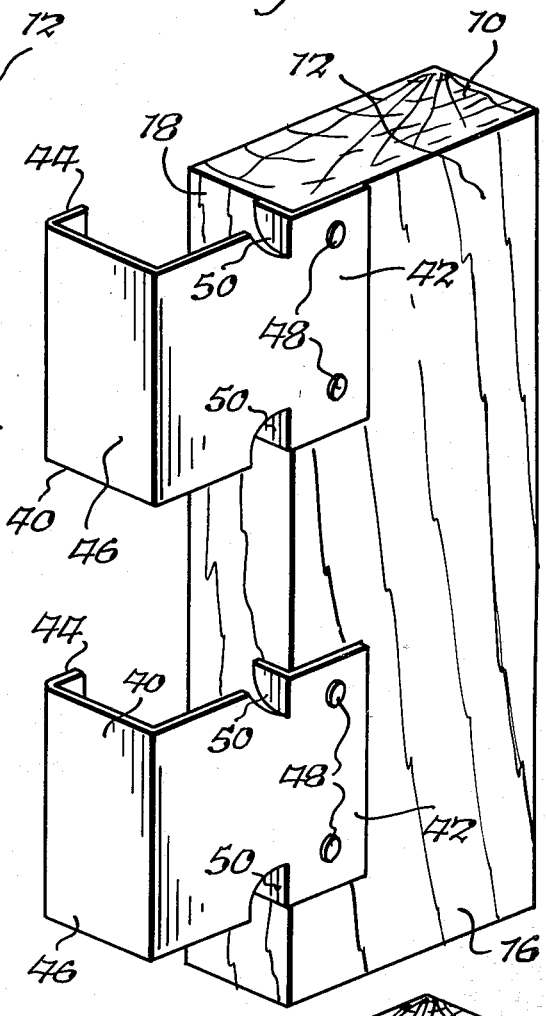
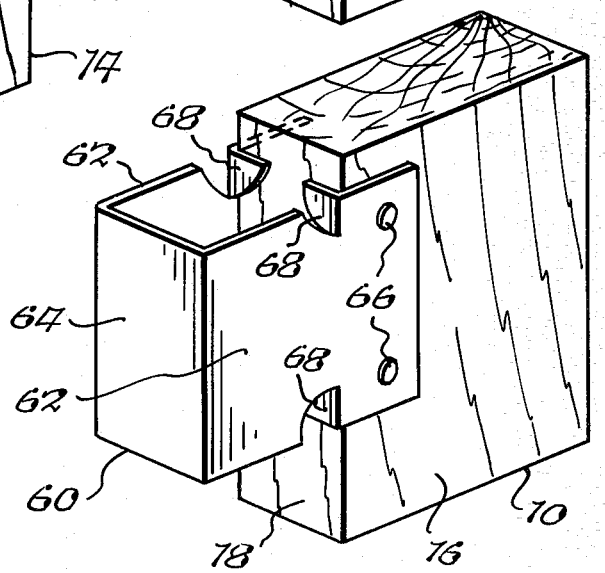
Fig. 3.

STUD EXTENDERS

This invention relates to a sheet metal stud extender, for attachment to a wood 2×4, so the combination can function as a 2×6 in wood frame construction.

A 2×4 stud is adequate in the construction of most homes, for the exterior wall framing, in all respect except where the extra thickness of insulation recommended requires a wider hollow wall to contain all the insulation.

In accordance with the present invention, the almost double cost of replacing 2×4 wood studs with 2×6 wood studs is avoided by the use of sheet metal stud extenders on the 2×4 wood studs so that they can function for all essential purposes in home exterior wall construction as 2×6 wood studs.

It is an object of the present invention to provide a relatively simple element to convert less costly smaller studs into a form essentially equivalent for the purpose to larger studs.

It is a further object to provide a novel combination for support of wood frame exterior walls having extra large space for insulation.

These and other objects and advantages of the present invention will be more fully apparent when considered in relation to the preferred embodiments thereof as set forth in the specification and as shown in the drawings in which:

FIG. 1 is an isometric view of a wood stud and a sheet metal stud extender, in accordance with the invention.

FIGS. 2 and 3 are isometric views of modified forms of the invention, substituting novel clips for the elongate channel of FIG. 1.

Referring to FIG. 1, there is shown a wood 2×4 stud 10, having a top end 12, a bottom end 14, a 3½" wide side 16 and a narrow front 18. Affixed to stud 10 is an elongate, J-shaped, formed sheet metal stud extender channel 20 having a wide flat side 22, parallel and spaced therefrom a narrow stiffener side 24 and, perpendicular to sides 22 and 24 and adjoining sides 22 and 24 at substantially square corners, there is a plain flat front 26 forming the outermost surface of extender channel 20. Channel 20 is affixed to stud 10 by a plurality of spaced nails or screws 28, extending through channel wide side 22 into stud wide side 16.

Channel wide side 22, of about three-inch width, has a plurality of small half-inch radius tabs 30 partially cut therefrom and bent inward therefrom, all disposed parallel to and two inches from channel front 26. Tabs 30 are disposed against stud front 18 and the remaining one inch of wide side 22 is disposed against and extends across a minor extent of the wide side 16 of wood stud 10.

Channel front 26, when formed of sheet metal of about 0.020 inch thickness, provides a surface against which wallboard or sheathing can be disposed, and to which it can be screw attached.

Referring to FIG. 2, there is shown a modified form of the invention, in which, affixed to a stud 10, there are a plurality of about three-inch long, J-shaped, sheet metal stud extender channel sections 40, having a wide flat side 42, parallel and spaced therefrom a narrow stiffener side 44, and perpendicular to sides 42 and 44 and adjoining sides 42 and 44, at substantially square corners, there is forming the outermost surface of extender channel section 40 front 46. Channel section 40 is affixed to stud 10 by nails or screws 48 extending through wide side 42 into stud wide side 16.

Channel section wide side 42 has a plurality of small tabs 50 partially cut therefrom and bent inwardly therefrom, all disposed parallel to and two inches from channel section front 46. Tabs 50 are disposed against stud front 18. Channel sections 40 function in the same manner as channel 20.

FIG. 3 shows a modified form of sheet metal stud extender channel section 60, having two wide flat sides 62, 62 parallel and spaced apart. Perpendicular to sides 62, 62 and adjoining the two sides 62, 62 at substantially square corners, is a plain flat front 64 forming the outermost surface of extender channel section 60. Channel section 60 is affixed to stud 10 by nails or screws 66 extending through wide sides 62, 62 and into stud wide side 16, and an opposite stud wide side (not shown).

Channel section wide sides 62, 62 have tabs 68, 68 partially cut therefrom and bent inwardly therefrom, all disposed parallel to and two inches from channel section front 64. Tabs 68, 68 are disposed against stud front 18. Channel section 60 functions in the same manner as channel 20.

Having completed a detailed disclosure of the preferred embodiments of my invention, so that others may practice the same, I contemplate that variations may be made without departing from the essence of the invention.

I claim:

1. A formed sheet metal stud extender consisting solely of a first wide flat side, a second side which is substantially parallel and spaced from said first wide flat side, and a flat front, free of any elements frontward thereof, said flat front being perpendicular to and adjoining said two sides at substantially square corners, all formed solely of sheet metal, said at least one wide flat side having means for locating said stud extender against a wood stud with the front of said extender in a uniform spaced parallel relationship to the front of said wood stud when said wide flat side is disposed against and extending across a minor extent of the side of said wood stud.

2. A stud extender as defined in claim 1 wherein said locating means comprise small tabs partially cut and bent inwardly from said wide side.

3. A stud extender as defined in claim 1 in which said stud extender locating means are disposed along a line parallel to said front and spaced about two inches therefrom.

4. In combination, a stud extender as defined in claim 1 and a wood stud, said stud extender wide side being mechanically affixed to a wide side of said stud and said stud extender front being parallel to and spaced from a front of said wood stud.

5. In the combination of claim 4, a stud extender having a length substantially equal to the length of said wood stud.

6. In the combination of claim 4, a stud extender having a relatively short length, relative to the length of said wood stud, and being spaced from additional stud extenders of similar structure which are similarly affixed to said wood stud.

7. In combination, a stud extender and a wood stud as defined in claim 4, and a layer of wallboard or sheathing mechanically attached to said flat front.

8. In the combination of claim 7, said wallboard or sheathing being screw attached to said flat front.

* * * * *

UNITED STATES PATENT AND TRADEMARK OFFICE

CERTIFICATE OF CORRECTION

PATENT NO. : 4,466,225

DATED : August 21, 1984

INVENTOR(S) : JOHN K. HOVIND

It is certified that error appears in the above-identified patent and that said Letters Patent are hereby corrected as shown below:

Column 1, lines 67 and 68, "there is forming the outermost surface of extender channel section 40 front 46." should have read ---there is a plain flat front 46 forming the outermost surface of extender channel section 40.---.

Signed and Sealed this

*Fifteenth* Day of *January 1985*

[SEAL]

*Attest:*

GERALD J. MOSSINGHOFF

*Attesting Officer*

*Commissioner of Patents and Trademarks*